US009163601B2

(12) United States Patent
Furuishi et al.

(10) Patent No.: US 9,163,601 B2
(45) Date of Patent: Oct. 20, 2015

(54) CONTROL DEVICE FOR INTERNAL COMBUSTION ENGINE

(75) Inventors: Akio Furuishi, Susono (JP); Shigeyuki Urano, Susono (JP); Yuusuke Suzuki, Hadano (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 175 days.

(21) Appl. No.: 13/984,540

(22) PCT Filed: Feb. 18, 2011

(86) PCT No.: PCT/JP2011/053530

§ 371 (c)(1),
(2), (4) Date: Aug. 9, 2013

(87) PCT Pub. No.: WO2012/111147

PCT Pub. Date: Aug. 23, 2012

(65) Prior Publication Data

US 2013/0319361 A1 Dec. 5, 2013

(51) Int. Cl.
*F02N 11/08* (2006.01)
*F02D 29/02* (2006.01)
(Continued)

(52) U.S. Cl.
CPC ..... *F02N 11/08* (2013.01); *F02D 29/02* (2013.01); *F02N 11/00* (2013.01); *F02N 99/006* (2013.01); *F02N 99/004* (2013.01); *F02N 2200/02* (2013.01); *F02N 2300/2002* (2013.01)

(58) Field of Classification Search
CPC . F02D 17/00; F02D 2200/1004; F02N 11/00; F02N 11/04; F02N 11/08; F02N 11/0848; F02N 19/004; F02N 19/005; F02N 2200/00
USPC ..... 123/179.1, 179.3, 179.12, 179.14, 123/406.52–406.54; 701/102–105, 701/112–114; 73/114.15
See application file for complete search history.

(56) References Cited

U.S. PATENT DOCUMENTS 4,993,388 A * 2/1991 Mitsumoto ..... 123/406.42
2004/0044461 A1* 3/2004 Ueda ..... 701/111
(Continued)

FOREIGN PATENT DOCUMENTS

DE 10 2004 017 496 2/2005
EP 1 400 687 3/2004
(Continued)

*Primary Examiner* — John Kwon
*Assistant Examiner* — Johnny H Hoang
(74) *Attorney, Agent, or Firm* — Finnegan, Henderson, Farabow, Garrett & Dunner, LLP

(57) ABSTRACT

An object of the present invention is to be able to execute motor assist only when it is necessary at a time of starting an engine, and drive a motor efficiently. An engine 10 includes a starter motor 34 for aiding in starting, and performs motor assist by the starter motor 34 in accordance with necessity when the engine is to start independently by combustion. An ECU 50 predicts a torque T1 that is generated in an initial explosion cylinder at a time of starting before actual combustion, and performs independent starting without driving the motor 34, when the prediction torque T1 is a starting request torque Ts1 or more. When the prediction torque T1 is less than the starting request torque Ts1, the ECU 50 drives the motor 34 and performs starting by motor assist. Thereby, power consumption of a battery and the like can be suppressed by decreasing wasteful drive of the motor, and the starter motor 34 can be efficiently driven while startability is secured.

3 Claims, 4 Drawing Sheets

(51) Int. Cl.
*F02N 11/00* (2006.01)
*F02N 99/00* (2010.01)

(56) References Cited

U.S. PATENT DOCUMENTS

| | | | | |
|---|---|---|---|---|
| 2004/0200448 | A1 | 10/2004 | Kojima et al. | |
| 2008/0162017 | A1* | 7/2008 | Nagata et al. | 701/103 |
| 2009/0159046 | A1* | 6/2009 | Moriya | 123/435 |
| 2011/0202263 | A1* | 8/2011 | Kawazu et al. | 701/113 |
| 2011/0238255 | A1* | 9/2011 | Sano et al. | 701/29 |

FOREIGN PATENT DOCUMENTS

| | | |
|---|---|---|
| JP | 03-242438 | 10/1991 |
| JP | 2000-73838 | 3/2000 |
| JP | 2005-2847 | 1/2005 |
| JP | 2005-016356 | 1/2005 |
| JP | 2008-040660 | 2/2008 |
| JP | 2008-185022 | 8/2008 |
| JP | 2009-013792 | 1/2009 |
| JP | 2009-209763 | 9/2009 |
| JP | 2010-77859 | 4/2010 |
| WO | WO 2006/070338 | 7/2006 |

* cited by examiner

CONTROL DEVICE FOR INTERNAL COMBUSTION ENGINE

CROSS-REFERENCE TO RELATED APPLICATIONS

This application is a national phase application of International Application No. PCT/JP2011/053530, filed Feb. 18, 2011, the content of which is incorporated herein by reference.

TECHNICAL FIELD

The present invention relates to, for example, a control device for an internal combustion engine, and more particularly relates to a control device for an internal combustion engine configured to aid in starting by a motor.

BACKGROUND ART

There is known a control device for an internal combustion engine including a motor that aids in starting, as is disclosed in, for example, Patent Literature 1 (Japanese Patent Laid-Open No. 2000-73838). The conventional art is configured such that when a variation amount ($dP/d\theta$) of a cylinder internal pressure P reaches a predetermined value or more at the time of starting the engine, the motor is stopped, and motor assist is cancelled. Thereby, in the conventional art, the motor is operated only in the time period until combustion becomes stable, and the fuel efficiency and the like are enhanced.

Note that the applicant recognizes the literatures described as follows including the above described literature, as those related to the present invention.

CITATION LIST

Patent Literature

Patent Literature 1: Japanese Patent Laid-Open No, 2000-73838

Patent Literature 2: Japanese Patent Laid-Open No. 2010-77859

Patent Literature 3: Japanese Patent Laid-Open No, 2009-209763

SUMMARY OF INVENTION

Technical Problem

Incidentally, in the conventional art, timing for cancelling motor assist is determined based on the variation amount of the cylinder internal pressure. However, since it is not determined whether motor assist is necessary or not at the stage before starting, the motor is sometimes driven wastefully even when the motor assist is not necessary, and therefore, there arises the problem of reducing operation efficiency.

The present invention is made to solve the problem as described above, and an object of the present invention is to provide a control device for an internal combustion engine that can execute motor assist only when it is necessary, and can efficiently drive a motor.

Means for Solving the Problem

A first aspect of the present invention is a control device for internal combustion engine, comprising:

a starter motor that is loaded on a direct-injection type internal combustion engine that directly injects a fuel into a cylinder, and is capable of aiding in starting the internal combustion engine;

cylinder internal pressure detecting means that detects a pressure in the cylinder;

generation torque predicting means that predicts a torque that is generated at a time of combustion, based on at least a cylinder internal pressure detected before combustion by the cylinder internal pressure detecting means;

combustion starting means that starts the internal combustion engine by combustion in the cylinder, when a starting request to the internal combustion engine is issued; and start aiding means that predicts a torque that is generated by combustion in an initial explosion cylinder before start of the combustion by the generation torque predicting means, when the starting request is issued, and drives the starter motor only when the prediction torque is smaller than a predetermined starting request torque.

In a second aspect of the present invention, a control device for internal combustion engine, further comprising:

start aid extending means that detects a cylinder with the prediction torque being the starting request torque or more out of a second and following cylinders that reach a combustion stroke, when the prediction torque of the initial explosion cylinder is smaller than the starting request torque, and stops the starter motor after continuing drive of the starter motor until an expansion stroke of the cylinder.

In a third aspect of the present invention, wherein the generation torque predicting means is configured to predict torques that are generated in individual cylinders, based on cylinder internal pressures and cylinder internal volumes of cylinders to be targets of prediction of torques, and temperature parameters comprising an engine temperature and/or an intake air temperature of the internal combustion engine.

Advantageous Effect of Invention

According to the first invention, the generation torque predicting means can calculate the prediction torque of the initial explosion cylinder before actual combustion. Thereby, at the time of restarting, only when the prediction torque is insufficient, the starter motor is driven and the internal combustion engine can be started smoothly. Further, when the prediction torque of the initial explosion cylinder is sufficient, independent staring can be performed by normal combustion without driving the starter motor. Accordingly, the power consumption of the battery and the like can be suppressed by decreasing wasteful drive of the motor, and the starter motor can be efficiently driven while startability is secured.

According to the second invention, when the prediction torque of the initial explosion cylinder is smaller than the starting request torque, a cylinder with the prediction torque being the starting request torque or more is detected out of the second and following cylinders that reach the combustion stroke, and drive of the starter motor can be continued until the expansion stroke of the cylinder. Namely, even when it is predicted that independent starting cannot be completed in the initial explosion cylinder, the independence enabling cylinder which enables shift to independent starting next to the initial explosion cylinder can be detected. If the starter motor is driven until the expansion stroke of the independence enabling cylinder, the internal combustion engine can be shifted to independent starting even if the motor is stopped at that point of time. Accordingly, the drive time period of the starter motor can be reduced as much as possible, and therefore, power consumption of the motor can be reliably suppressed even at the time of cold start or the like.

According to the third invention, the generation torque predicting means can predict torques that are generated in individual cylinders, based on cylinder internal pressures and cylinder internal volumes of cylinders to be targets of prediction of torques, and temperature parameters constituted of an engine temperature and/or an intake air temperature of the internal combustion engine. Thereby, temperature correction of the prediction torque can be accurately performed based on the temperature parameters such as the engine water temperature and the intake air temperature, and the prediction torque that is more accurate can be obtained.

DESCRIPTION OF EMBODIMENTS

Embodiment 1

Configuration of Embodiment 1

Figure 1:
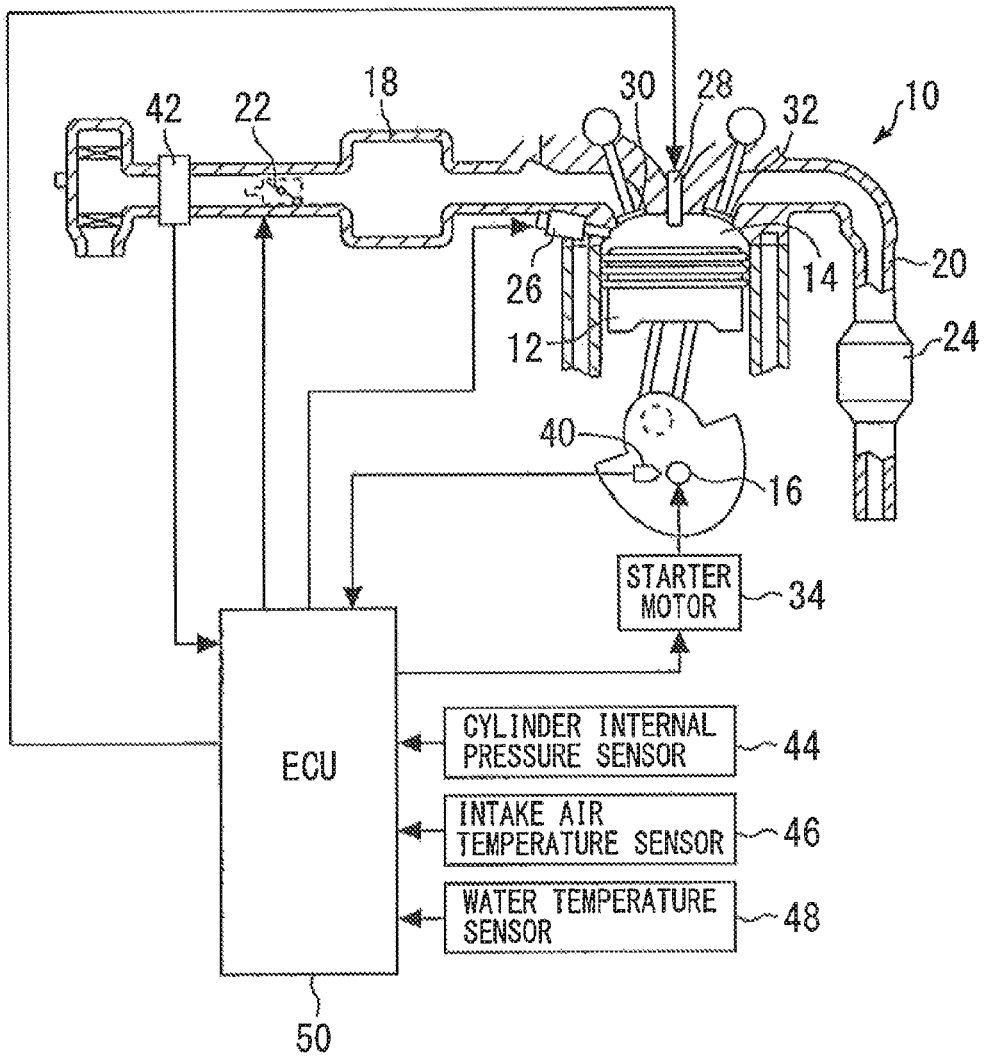
FIG. 1 is a general configuration diagram for explaining a system configuration of embodiment 1 of the present invention.

Hereinafter, embodiment 1 of the present invention will be described with reference to FIG. 1 and FIG. 5. FIG. 1 is a general configuration diagram for explaining a system configuration of embodiment 1 of the present invention. A system of the present embodiment includes an engine 10 that is a direct-injection type internal combustion engine, and in each of cylinders of the engine 10, a combustion chamber 14 is formed by a piston 12. The piston 12 of each of the cylinders is connected to a crankshaft 16 of the engine. Note that FIG. 1 illustrates only one cylinder out of a plurality of cylinders loaded on the multi-cylinder type engine 10.

Further, the engine 10 includes an intake passage 18 that takes intake air into the combustion chamber 14 (inside the cylinder) of each of the cylinders and an exhaust passage 20 that discharges exhaust gas of each of the cylinders. The intake passage 18 is provided with an electronically controlled type throttle valve 22 that regulates an intake air amount, and the exhaust passage 20 is provided with a catalyst 24 that purifies exhaust gas. Further, each of the cylinders is provided with a fuel injection valve 26 that directly injects a fuel into the cylinder, an ignition plug 28 that ignites mixture gas in the cylinder, an intake valve 30 that opens and closes the intake passage 18 to the inside of the cylinder, and an exhaust valve 32 that opens and closes the exhaust passage 20 to the inside of the cylinder.

Further, the system of the present embodiment is applied to, for example, an idle stop vehicle and a hybrid vehicle, and includes an electric starter motor 34 that performs starting aid (motor assist) of the engine 10. In an idle stop vehicle and a hybrid vehicle, the engine which is temporarily stopped is restarted during stopping (traveling) in some cases. The starter motor 34 is configured to drive the crankshaft 16 rotationally in accordance with necessity, and aid in starting, at the time of such restart.

Further, the system of the present embodiment includes a sensor system including a crank angle sensor 40, an airflow sensor 42, a cylinder internal pressure sensor 44, an intake air temperature sensor 46, a water temperature sensor 48*a* and the like, and an ECU (Electronic Control Unit) 50 that controls an operating state of the engine 10. Explaining the sensor system first, the crank angle sensor 40 outputs a signal that is synchronized with rotation of the crankshaft 16, and the airflow sensor 42 detects an intake air amount of the engine. Further, the cylinder internal pressure sensor 44 configures cylinder internal pressure detecting means of the present embodiment, and individually detects a cylinder internal pressure P of each cylinder, and is provided at each of the cylinders. Meanwhile, the intake air temperature sensor 46 detects a temperature (intake air temperature) Ta of the intake air, whereas the water temperature sensor 48 detects a temperature (engine water temperature) Tw of engine cooling water, and these intake air temperature and engine water temperature are temperature parameters for use in generation torque prediction processing and torque determination processing which will be described later.

Further, the sensor system also includes various sensors necessary for control of the engine 10 and the vehicle which is loaded with the engine 10, besides the above described sensors. More specifically, they are an air-fuel ratio sensor that detects an exhaust air-fuel ratio, an accelerator opening sensor that detects an accelerator operating amount (accelerator opening) of the vehicle, and the like. These sensors are connected to an input side of the ECU 50. Meanwhile, various actuators including the throttle valve 22, the fuel injection valve 26, the ignition plug 28, the starter motor 34 and the like are connected to an output side of the ECU 50.

The ECU 50 performs operation control by driving the respective actuators based on operation information of the engine that is detected by the sensor system. More specifically, the ECU 50 detects an engine speed (engine rotational frequency) and a crank angle based on the output of the crank angle sensor 40. The ECU 50 detects a position of the piston 12 of each of the cylinders based on the crank angle, and executes cylinder discrimination processing of discriminating the cylinder to be a target of fuel injection and ignition. Further, the ECU 50 calculates engine load based on the intake air amount by the airflow sensor and the engine speed, calculates a fuel injection amount based on the intake air amount, the engine load and the like, and determines fuel injection timing and ignition timing based on the crank angle. Subsequently, the ECU 50 drives the fuel injection valve 26 at a point of time when the fuel injection timing arrives, and drives the ignition plug 28 at a point of time when the ignition timing arrives.

Feature of the Present Embodiment

The present embodiment is configured to perform motor assist only for a minimum time period only when it is necessary, when the engine 10 is restarted. Describing more specifically, for example, when an idle stop vehicle starts from a stopping state, and when a hybrid vehicle is switched to engine traveling from motor traveling, a starting request to the engine is issued, and the engine which is temporarily stopped is restarted. In this case, a fuel injected into the cylinder from the fuel injection valve 26 is basically combusted to start the engine independently (hereinafter, starting by combustion will be called independent starting). However, depending on the position of the piston 12 of each of the cylinders, a combustion stroke does not arrive soon, or torque sufficient for starting cannot be generated by combustion in some cases. Therefore, when a starting request is issued, generation torque prediction processing and torque determination processing which will be described as follows are executed first based on the position of the piston 12 or the like, and it is determined whether or not motor assist is used in combination based on the determination result.

(Generation Torque Prediction Processing)

In this processing, the position of the piston of each of the cylinders is first detected based on the output of the crank angle sensor 40, and the cylinder (initial explosion cylinder) where the piston is in an expansion stroke during stop of starting is determined. Subsequently, an air amount in the initial explosion cylinder is calculated by using the fact that the cylinder internal pressure P of the initial explosion cylinder which is detected by the cylinder internal pressure sensor 44, a cylinder internal volume V calculated based on a crank angle, and an intake air temperature T detected by the intake air temperature sensor 46 satisfy the equation of state of gas shown in the following equation (1), and a prediction value of torque (prediction torque) which is generated when the air is combusted with a predetermined A/F (for example, a theoretical air-fuel ratio) is calculated. Note that in equation (1), R represents a gas constant, and n represents the number of moles of air.

$$P*V=n*R*Ta \quad (1)$$

In the generation torque prediction processing, the prediction torque T1 of the initial explosion cylinder is calculated before actual combustion by the above described processing, and temperature correction of the calculation result thereof is performed based on the engine water temperature Tw and the intake air temperature Ta. Note that a data map and the like which are necessary for temperature correction are stored in the ECU 50 in advance.

(Torque Determination Processing)

In the processing, a minimum value (starting request torque) Ts1 of the generation torque that is necessary to perform independent starting without motor assist in the initial explosion cylinder is calculated first. The starting request torque Ts1 is easily found by measurement or the like in a real machine, and temperature correction of the starting request torque Ts1 is properly performed based on the engine water temperature Tw and the intake air temperature Ta substantially similarly to the occasion of calculation of the prediction torque T1. Subsequently, when the prediction torque T1 of the initial explosion cylinder is the starting request torque Ts1 or more, starting is enabled without motor assist, and therefore, the engine is independently started by combustion in the initial explosion cylinder and the following cylinders without driving the starter motor 34.

(Motor Assist Processing)

Figure 2:
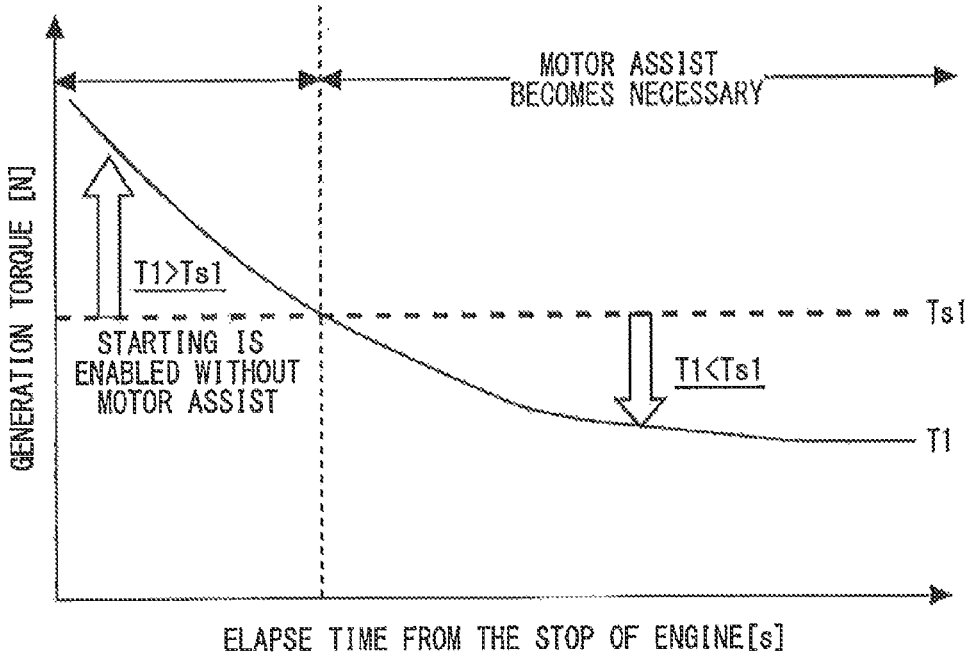
FIG. 2 is an explanatory diagram showing a state in which the starting request torque at a time of restarting varies with time.

Meanwhile, when the prediction torque T1 of the initial explosion cylinder is less than the starting request torque Ts1, independent starting cannot be performed with only the combustion in the initial explosion cylinder. Consequently, in this case, the starter motor 34 is driven at the time of combustion of at least the initial explosion cylinder, and motor assist is executed. FIG. 2 is an explanatory diagram showing a state in which the starting request torque at a time of restarting varies with time. As shown in the drawing, when the engine stops, the air in the cylinder tends to leak to an outside through, for example, a damage of a cylinder liner, slack of a piston ring and the like. Especially in the engine where deterioration over time or the like advances, the tendency is noticeable. Therefore, when time elapses from the stopping time of the engine, the prediction torque T1 which is sufficiently large initially reduces to be less than the starting request torque Ts1, and motor assist sometimes becomes necessary.

In contrast with this, according to the above described motor assist processing, the cylinder internal air amount is calculated based on the cylinder internal pressure P, and the prediction torque T1 of the initial explosion cylinder can be further calculated before actual combustion. Thereby, at the time of restart, only when the prediction torque T1 is insufficient, the starter motor 34 is driven and the engine 10 can be smoothly started. Further, when the prediction torque T1 of the initial explosion cylinder is sufficient, independent starting can be performed by normal combustion without driving the starter motor 34. Accordingly, wasteful drive of the motor is decreased, and power consumption of a battery and the like can be suppressed, whereby the starter motor 34 can be operated efficiently while startability is secured. Further, temperature correction of the prediction torque T1 is performed based on the temperature parameters such as the engine water temperature and the intake air temperature, whereby the prediction torque T1 which is more accurate can be obtained.

(Assist Extension Processing)

Meanwhile, when the prediction torque T1 of the initial explosion cylinder is less than the starting request torque Ts1, and motor assist processing is executed, assist extension processing is executed, and until what time point after starting the motor assist is necessary is determined. In the assist extension processing, with respect to the second and following cylinders which reach an combustion stroke, the prediction torques Tn (n represents a cylinder number: 2, 3, . . . ) are calculated respectively by the aforementioned calculation method, and the cylinder (hereinafter, called an independence enabling cylinder) in which the prediction torque Tn is the starting request torque Tsn (n=2, 3, . . . ) of the cylinder or more is detected. Subsequently, drive of the starter motor 34 is continued until an expansion stroke of the independence enabling cylinder, and thereafter, the starter motor 34 is stopped. Note that a specific example of the assist extension processing will be described in detail in a flowchart (FIG. 5) that will be described later.

Figure 3:
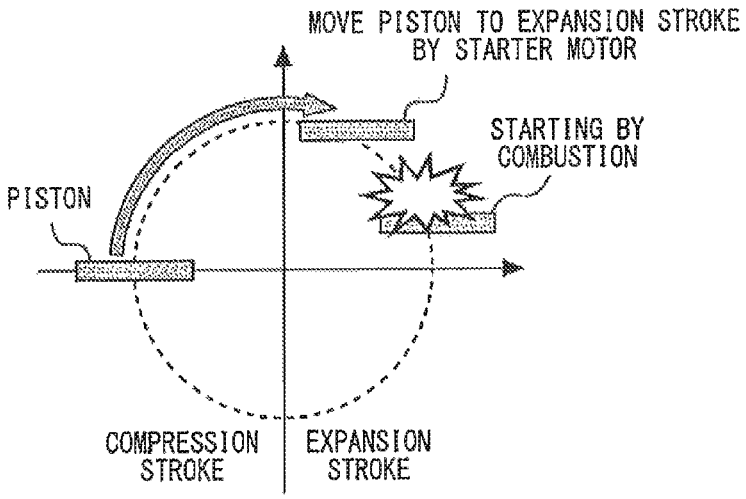
FIG. 3 is an explanatory view showing a position and a behavior of the piston in the independence enabling cylinder.

FIG. 3 is an explanatory view showing a position and a behavior of the piston in the independence enabling cylinder. As shown in the drawing, when the piston is before a top dead center in the independence enabling cylinder, a torque to a regular rotational direction cannot be generated by combustion, but when the piston is moved to the position of the top dead center and the following position by the starter motor 34, independent starting can be performed thereafter by combustion. Therefore, in the above described assist extension processing, drive of the starter motor 34 is continued until the expansion stroke of the independence enabling cylinder.

Figure 4:
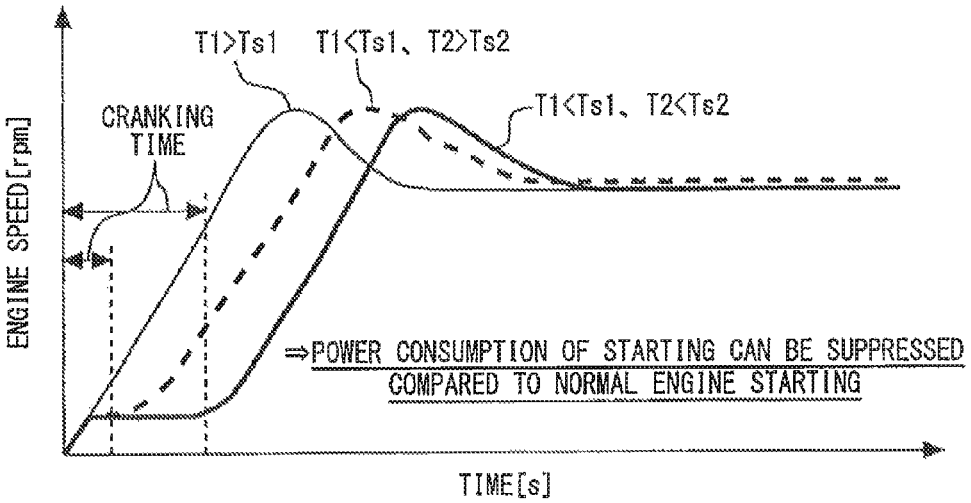
FIG. 4 is a characteristic chart showing cranking time periods in the case of executing the motor assist processing and the assist extension processing by being compared with each other.

FIG. 4 is a characteristic chart showing cranking time periods in the case of executing the motor assist processing and the assist extension processing by being compared with each other. As shown in the chart, when independent starting is enabled in the initial explosion cylinder, the cranking time period becomes the shortest. Further, when independent starting is enabled in the second cylinder and the following cylinders the cranking time period becomes shorter correspondingly. Consequently, according to the assist extension processing, even when it is predictable that independent starting cannot be completed in the initial explosion cylinder, the independence enabling cylinder capable of shifting to independent starting next to the initial explosion cylinder can be detected. If the starter motor 34 is driven until the expansion stroke of the independence enabling cylinder, the engine can be shifted to independent starting, even when the motor is stopped at that point of time. Namely, the drive time period of the starter motor 34 can be reduced as much as possible, and therefore, power consumption of the motor can also reliably be suppressed at the time of cold start and the like.

Further, in the present embodiment, when independent starting is estimated to be difficult in the initial explosion cylinder and the second explosion cylinder, that is, when T1<Ts1 and T2<Ts2 are established, independent starting by combustion is determined to be impossible. Namely, when the prediction torques Tn of all the cylinders are less than the starting request torque Tsn at the time of starting, the starter motor 34 is continued to be driven until, for example, the engine speed exceeds a predetermined value corresponding to independent operation, and thereby, normal engine starting is executed.

Specific Processing for Realizing Embodiment 1

Next, with reference to FIG. 5, specific processing for realizing the above described control will be described. FIG. 5 is a flowchart showing the control which is executed by the ECU in embodiment 1 of the present invention. A routine shown in the drawing is executed when starting request of the engine is issued by another device or the like during operation of the engine. In the routine shown in FIG. 5, the positions of the pistons of all the cylinders are detected based on the output of the crank angle sensor 40 first in step 100. Next, in step 102, the cylinder internal air amounts are calculated by using the aforementioned equation (1) for the respective cylinders, and further in step 104, torques (prediction torques Tn) generated by combustion in the cylinders are calculated.

Next, in step 106, the starting request torque Ts1 is calculated by the aforementioned method, and it is determined whether or not the prediction torque T1 of the initial explosion cylinder is larger than the starting request torque Ts1. When the determination is established, motor assist does not have to be performed, and therefore, normal independent start control is executed in step 108. Meanwhile, when the determination of step 106 is not established, the prediction torque T2 of the cylinder which reaches the combustion stroke next is calculated in step 110. Subsequently, in step 112, it is determined whether or not the prediction torque T1 is larger than the starting request torque Ts1, and when the determination is established, in step 114, the starter motor 34 is driven, whereby the piston of the cylinder which reaches the combustion stroke next is moved to the position corresponding to the expansion stroke, and thereafter, in step 108, normal independent start control is executed.

Further, when the determination of step 112 is not established, it is conceivable that even in the second cylinder, independent starting cannot be completed. Therefore, in that case, in step 116, the piston of the cylinder which reaches the combustion stroke thirdly is moved to the position corresponding to the expansion stroke by the starter motor 34, and thereafter, normal independent start control is executed in step 108.

Figure 5:
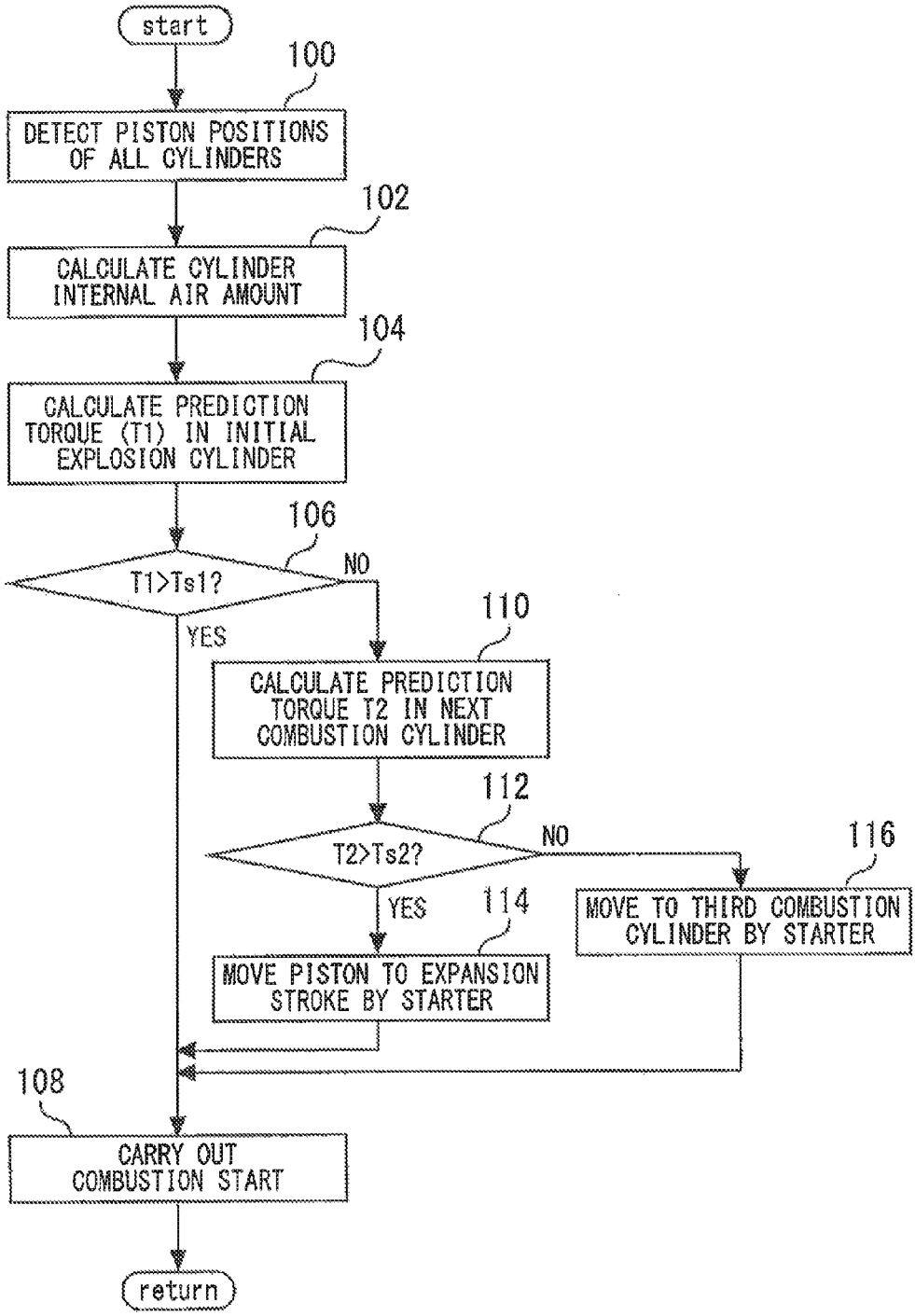
FIG. 5 is a flowchart showing the control which is executed by the ECU in embodiment 1 of the present invention.

Note that in the aforementioned embodiment 1, step 108 in FIG. 5 shows a specific example of combustion starting means in claim 1, and steps 100, 102, 104, 106, 110, 112, 114 and 116 show specific examples of start aiding means in claim 1. Further, steps 110, 112, 114 and 116 show specific examples of start aid extending means in claim 2.

Further, the embodiment is configured so that when independent starting is estimated to be difficult in the initial explosion cylinder, it is determined whether or not independent starting is enabled in the second explosion cylinder, and drive of the starter motor 34 is continued until the expansion stroke of the independence enabling cylinder in accordance with necessity. However, the present invention is not limited to this, and may be configured to execute motor assist irrespective of the situations of the other cylinders, at the point of time when independent starting in the initial explosion cylinder is estimated to be difficult.

Further, in the present invention, such a configuration may be adopted, that the A/F used at the time of starting is switched in response to an activation state of the catalyst 24. Citing a specific example, a configuration may be adopted in which, for example, when the catalyst is activated, the A/F at the time of restarting is set at 14.5 or the like with high purification ability thereof taken into consideration, and exhaust emission is improved. Further, when the catalyst is inactivated, the A/F at the time of restarting may be set at, for example, 12.5 (value at which the torque becomes maximum) or the like.

Further, the aforementioned embodiment is configured such that with respect to each of the second cylinders which reach the explosion stroke after the initial explosion cylinders, the prediction torques T1 and T2 and the starting request torques Ts1 and Ts2 are compared. However, the present invention is not limited to this, and, for example, in the internal combustion engine having the number of cylinders of four or more, such a configuration may be adopted, that with the initial explosion cylinder set as the base point, the prediction torques Tn and the starting request torques Tsn (n=1, 2, 3, . . . : the number of cylinders) are sequentially compared, and motor assist is executed until the expansion stroke of the cylinder in which Tn≥Tsn is established.

DESCRIPTION OF REFERENCE NUMERALS

10 engine (internal combustion engine), 12 piston, 14 combustion chamber, 16 crankshaft, 18 intake passage, 20 exhaust passage, 22 throttle valve, 24 catalyst, 26 fuel injection valve, 28 ignition plug, 30 intake valve, 32 exhaust valve, 34 starter motor, 40 crank angle sensor, 42 airflow sensor, 44 cylinder internal pressure sensor, 46 intake air temperature sensor, 48 water temperature sensor, 50 ECU, Ts1 starting request torque

The invention claimed is:

1. A control device for an internal combustion engine, comprising:

a starter motor that is loaded on a direct-injection type internal combustion engine that directly injects a fuel into a cylinder, and is capable of aiding in starting the internal combustion engine;

cylinder internal pressure detecting unit that detects a pressure in the cylinder;

generation torque predicting unit that predicts a torque that is generated at a time of combustion, based on at least a cylinder internal pressure detected before combustion by the cylinder internal pressure detecting unit;

combustion starting unit that starts the internal combustion engine by combustion in the cylinder, when a starting request to the internal combustion engine is issued;

start aiding unit that predicts a torque that is generated by combustion in an initial explosion cylinder before start of the combustion by the generation torque predicting unit, when the starting request is issued, and drives the starter motor only when the prediction torque is smaller than a predetermined starting request torque; and start aid extending unit that detects a cylinder with the prediction torque being the starting request torque or more out of a second and following cylinders that reach a combustion stroke, when the prediction torque of the initial explosion cylinder is smaller than the starting request torque, and stops the starter motor after continuing drive of the starter motor until an expansion stroke of the cylinder.

2. The control device for an internal combustion engine according to claim 1, wherein:

the generation torque predicting unit is configured to predict torques that are generated in individual cylinders, based on cylinder internal pressures and cylinder internal volumes of cylinders to be targets of prediction of torques, and temperature parameters comprising an engine temperature and/or an intake air temperature of the internal combustion engine and the start aid extending unit is configured such that, with the initial explosion cylinder set as a base point, the prediction torques of the individual cylinders and the starting request torques required for the individual cylinders are sequentially compared, and drive of the starter motor is continued until an expansion stroke of the cylinder in which the prediction torque is equal to or larger than the starting request torque.

3. The control device for an internal combustion engine according to claim 1, wherein the generation torque predicting unit is configured to predict torques that are generated in individual cylinders, based on cylinder internal pressures and cylinder internal volumes of cylinders to be targets of prediction of torques, and temperature parameters comprising an engine temperature and/or an intake air temperature of the internal combustion engine.

* * * * *